US006595329B1

(12) United States Patent
Gotz

(10) Patent No.: US 6,595,329 B1
(45) Date of Patent: Jul. 22, 2003

(54) FORKLIFT TRUCK WITH A LIFTING DEVICE

(75) Inventor: Bernhard Gotz, Aschaffenburg (DE)

(73) Assignee: Linde Aktiengesellschaft (DE)

( * ) Notice: Subject to any disclaimer, the term of this patent is extended or adjusted under 35 U.S.C. 154(b) by 0 days.

(21) Appl. No.: 09/510,785

(22) Filed: Feb. 23, 2000

(30) Foreign Application Priority Data

Feb. 25, 1999 (DE) ..... 199 08 200

(51) Int. Cl.[7] ..... B66F 9/06

(52) U.S. Cl. ..... 187/228; 187/222; 187/227; 187/235; 187/275; 187/413

(58) Field of Search ..... 187/222, 227, 187/228, 233, 235, 272, 274, 275, 413

(56) References Cited

U.S. PATENT DOCUMENTS 2,457,366 A * 12/1948 Guerin ..... 214/113
2,978,129 A * 4/1961 Becker ..... 414/918
3,010,594 A * 11/1961 Farmer ..... 414/918
RE25,548 E * 4/1964 Becker ..... 414/918
3,826,393 A * 7/1974 Carroll ..... 214/674
3,861,535 A * 1/1975 Huxley, III et al. ..... 214/6 B
5,480,275 A * 1/1996 Talbert et al. ..... 414/635

* cited by examiner

*Primary Examiner*—Eileen D. Lillis
*Assistant Examiner*—Michael Lowe
(74) *Attorney, Agent, or Firm*—Webb Ziesenheim Logsdon Orkin & Hanson, P.C.

(57) ABSTRACT

A forklift truck includes two driven front wheels, a lifting device, and at least one elevatable component. A flexible hydraulic line is wound up on a drum of the forklift truck. The hydraulic line connects the elevatable component with a non-elevatable component of the forklift truck. The drum is preferably located at least partly between the front wheels of the forklift truck. The front wheels are each driven by respective wheel motors.

6 Claims, 1 Drawing Sheet

FORKLIFT TRUCK WITH A LIFTING DEVICE

BACKGROUND OF THE INVENTION

1. Field of the Invention

The present invention relates to a forklift truck generally having two driven front wheels, a lifting device and at least one elevatable component and, more particularly, to a forklift truck having a flexible hydraulic line that may be wound up on a drum and which connects the elevatable component with a non-elevatable component of the forklift truck.

2. Description of the Prior Art

Forklift trucks known in the prior art typically have a lifting device fastened to a front end of the forklift truck. The driven front wheels of the forklift truck are located as close as possible behind the lifting device. The lifting device is frequently provided in the form of a lifting frame that is equipped with hydraulic lifting cylinders. A portion of the lifting device is fastened to a frame of the forklift truck so that it cannot be moved vertically, and there is at least one additional portion of the lifting device that can be elevated. At least one of the hydraulic cylinders of the lifting device is frequently fastened to the elevatable part of the lifting frame. Additional elevatable components are often provided on the elevatable portion. These ancillary devices, such as load-gripping devices or load pushers, are mounted on the elevatable portion of the lifting frame and are also equipped with hydraulically operated components.

To supply the above-mentioned ancillary devices and/or elevatable portion of the lifting frame with hydraulic fluid, the prior art generally discloses the use of a flexible hydraulic line that can be wound up on a drum. This flexible hydraulic line connects the elevatable component with a pump and/or a valve which is fastened to a non-elevatable component of the forklift truck.

In systems known in the prior art, the drum for the flexible hydraulic line is located in an upper portion of the lifting device. This arrangement requires a complicated, expensive and time-consuming assembly and installation process. Under certain operating conditions, the drum often blocks the driver's view of the load. In addition, as a result of the exposed location of the hydraulic line, there is also a risk that the line will be damaged by external objects.

An object of the invention is therefore to provide a forklift truck that is easy to manufacture. It is a further object of the present invention to provide a forklift truck on which the flexible hydraulic line is protected and the driver's view is unobstructed.

SUMMARY OF THE INVENTION

The present invention is directed to a forklift that includes a drum which is located at least partly between the front wheels of the forklift truck. In this arrangement, the drum for the flexible hydraulic line is located inside the body of the forklift truck. The installation of the drum in this position eliminates interference with the driver's field of vision. As a result of the location of the drum centrally between the front wheels, it is also unnecessary to bend the hydraulic line in a transverse direction with respect to the forklift truck. The installation of the drum may be carried out independently of the installation of the lifting device.

The front wheels of the forklift truck are preferably each driven by means of individual wheel motors. In this type of system, there is no continuous drive axle. The wheel motors and the front wheels may be fastened to a drive housing that is, for example, open at the top and at the front. In this configuration, the drive housing may be provided in the form of a component of the frame of the forklift truck or in the form of a housing component that is separate from the frame. Consequently, there is an easily accessible free space between the front wheels, wherein the drum for the flexible hydraulic line may be located. It is particularly advantageous if the drum is located at least partly between the wheel motors.

The elevatable component may be a part of the lifting frame of the forklift truck. For example, hydraulic cylinders may be fastened to the elevatable portion of the lifting frame. The cylinders may then be supplied with hydraulic fluid by means of the flexible hydraulic line.

It is also advantageous if the elevatable component is a hydraulically operated ancillary device.

The drum may be fastened to a drive housing that connects the two wheel motors. The drum with the hydraulic line may be fastened as early in the construction process as during the prefabrication of a component that contains the drive housing.

Furthermore, it is possible to fasten the drum to a non-elevatable portion of the lifting frame. In this case, the drum is pre-installed on the lifting frame before the final assembly of the forklift truck, so that after the connection has been made between the lifting frame and the frame of the forklift truck the drum will be located between the front wheels.

Additional advantages and details of the present invention are explained in greater detail below with reference to the exemplary embodiment illustrated in the accompanying schematic figures.

DETAILED DESCRIPTION OF THE PREFERRED EMBODIMENTS

Figure 1:
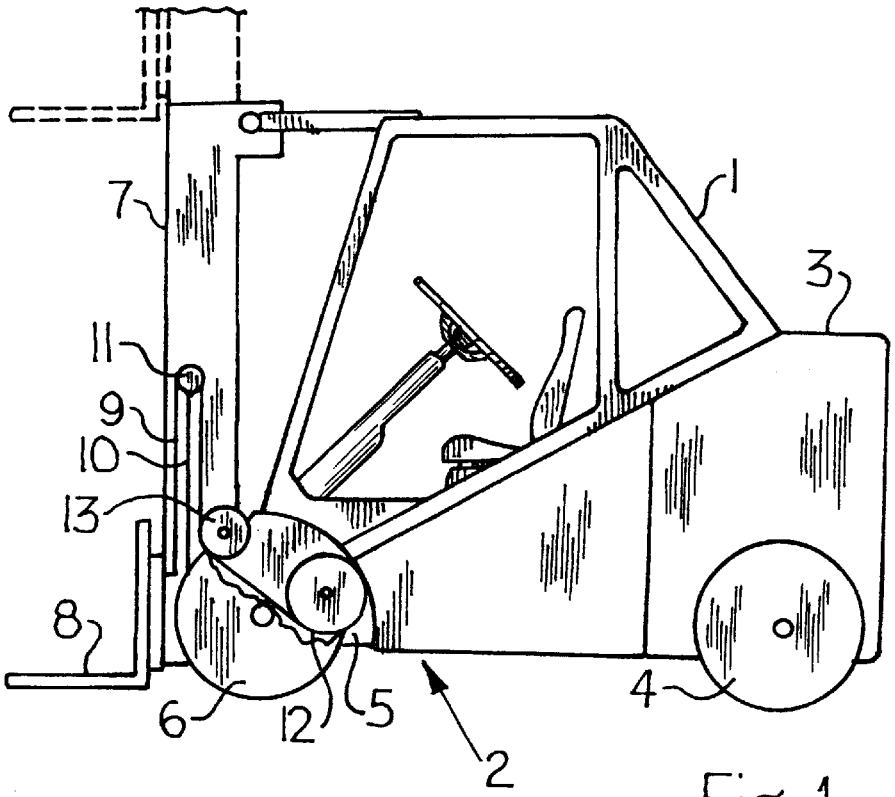
FIG. 1 is a side view of a forklift truck of the invention.

FIG. 1 shows a forklift truck 1 made in accordance with the present invention and having a driver's cab which is also a part of a frame 2 of the forklift truck 1. Fastened to a rear segment of the frame 2 is a rear weight 3. The rear weight 3 is supported on a steerable rear axle having rear wheels 4.

A drive housing 5 is fastened to a front segment of the frame 2 either rigidly or by means of elastic damping elements. On each of the two sides of the drive housing 5 there is a wheel motor and a front wheel 6 of the forklift truck 1. In the space between the two front wheels 6 there are no components of the drive housing 5, of the frame 2, or of a drive system of the forklift truck 1.

Fastened to a forward portion of the frame 2 is an extendable lifting frame 7, on which are located load-holding means 8 with a hydraulically operated ancillary device (not shown). A flexible hydraulic line 9, which is preferably in the form of a hose, leads to the ancillary device. The flexible hydraulic line 9 is guided by means of a roller 11 that is fastened to a hydraulic cylinder 10. To make it possible to elevate the load-holding means 8 into the position illustrated by the broken lines in FIG. 1, the flexible hydraulic line 9 is partly wound up on a drum 12, from which the hydraulic line 9 may be automatically paid out as necessary. There is also a deflector roller 13 located in the lower portion of the lifting frame 7.

The drum 12 of the present invention is located in part between the front wheels 6 of the forklift truck 1.

The drum 12 is thereby protected against external influences, and is also located outside the driver's field of vision.

Figure 2:
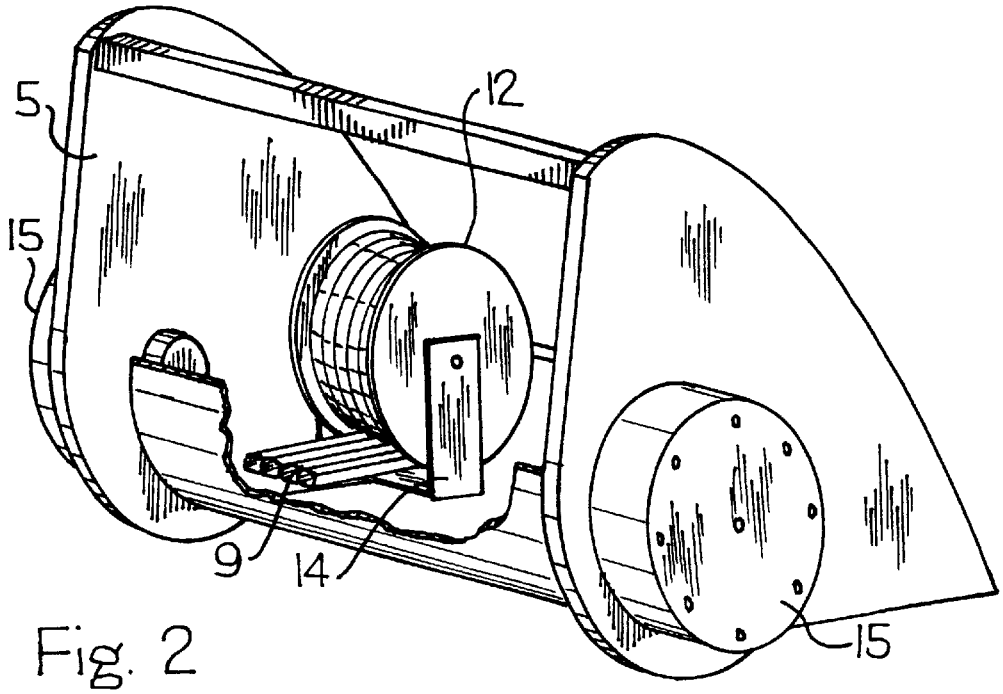
FIG. 2 is a view in perspective of a drive housing of the forklift truck.

FIG. 2 shows the drive housing 5 of the forklift truck 1 with the drum 12, which is located completely inside the drive housing 5. The drum 12 is fastened to the underside of the drive housing 5 by means of a bracket 14. It can also be fastened to another part of the drive housing 5, e.g. to a lateral surface. Wheel motors 15 are located on each side of the drive housing 5, whereby the front wheels 6, not shown in this FIG. 2, are flange-mounted on the housings of the wheel motors 15.

Obvious modifications and alterations of the present invention may be made without departing from the spirit and scope of the invention. The scope of the present invention is defined in the appended claims and equivalents thereto.

I claim:

1. A forklift truck having a frame, comprising:

two front wheels driven by respective drive motors, with the front wheels not interconnected by an axle so as to define a space between the front wheels;

a lifting device having a deflector roll attached thereto;

at least one elevatable component connected to the lifting device;

a drive housing located in the space between the front wheels, with the drive motors attached to lateral sides of the drive housing, respectively;

a drum located within the drive housing;

a hydraulic cylinder attached to the lifting device and having a second deflector roll attached thereto, and a flexible hydraulic line configured to round up on the drum;

wherein the hydraulic line is configured to connect the elevatable component with a non-elevatable component of the forklift truck, and wherein the hydraulic line is guided by the deflector roll and the second deflector roll attached to the hydraulic cylinder to connect the elevatable component with the non-elevatable component.

2. The forklift truck as claimed in claim 1, wherein the elevatable component is a part of a lifting frame of the forklift truck.

3. The forklift truck as claimed in claim 2, wherein the elevatable component is a hydraulically operated ancillary device.

4. The forklift truck as claimed in claim 2, wherein the drum is fastened to a bottom inner side of the drive housing by a bracket.

5. The forklift truck as claimed in claim 1, wherein the elevatable component is a hydraulically operated ancillary device.

6. The forklift truck as claimed in claim 5, wherein the drum is fastened to a bottom inner side of the drive housing by a bracket.

* * * * *